US005219005A

United States Patent [19]

Stoffel

[11] Patent Number: 5,219,005

[45] Date of Patent: Jun. 15, 1993

[54] METHOD FOR READYING A TWIN CHAMBER CONTAINER TO BE FILLED WITH A PRODUCT

[76] Inventor: Hans Stoffel, 68 Main St., Tuckahoe, N.Y. 10707

[21] Appl. No.: 791,245

[22] Filed: Nov. 13, 1991

Related U.S. Application Data

[62] Division of Ser. No. 480,666, Feb. 15, 1990, Pat. No. 5,137,179.

[51] Int. Cl.[5] ..... B65B 3/12

[52] U.S. Cl. ..... 141/3; 141/20

[58] Field of Search ..... 141/3, 2, 18, 20, 103, 141/104, 85; 222/95, 105, 386.5, 389; 53/470

[56] References Cited

U.S. PATENT DOCUMENTS

| | | | |
|---|---|---|---|
| 3,477,195 | 11/1969 | Chambers | 53/470 |
| 3,572,402 | 3/1971 | Beffel | 141/3 |
| 3,797,534 | 3/1974 | Skidmore | 141/3 |
| 4,271,875 | 6/1981 | Meshberg | 141/3 |
| 4,342,346 | 8/1982 | Wei | 141/85 |
| 4,746,743 | 8/1982 | Miller | 141/3 |
| 4,969,577 | 11/1990 | Werding | 222/94 |
| 5,031,384 | 7/1991 | Rebeyrolle | 53/470 X |
| 5,137,179 | 8/1992 | Stoffel | 222/95 |

FOREIGN PATENT DOCUMENTS

| | | | |
|---|---|---|---|
| 0105537 | 8/1983 | European Pat. Off. . | |
| 2308549 | 12/1976 | France | 141/3 |
| 9101252 | 2/1991 | World Int. Prop. O. | 141/3 |

*Primary Examiner*—Ernest G. Cusick

*Attorney, Agent, or Firm*—Antonelli, Terry Stout & Kraus

[57] ABSTRACT

A twin-chamber container which includes an outer plastic container with a valve mounted thereon and an inner collapsible container mounted in communication with the valve. A space between the container is pressurized to collapse the inner container when the valve is opened for permitting the dispensing of material from the inner container. A flowable resin is located in the space between the containers where it hardens at the area of the opening in the outer container having the valve arrangement for forming a seal. A method for preparing a twin-chamber container, ready to be filled with a product, involves pressurizing the intermediate chamber between the outer container and the inner collapsible container with a gas and transporting the twin-chamber container with the pressurized intermediate chamber to a filling station for filling a product into the inner container through the valve of the container.

9 Claims, 3 Drawing Sheets

METHOD FOR READYING A TWIN CHAMBER CONTAINER TO BE FILLED WITH A PRODUCT

This is a division of application Ser. No. 07/480,666, filed Feb. 15, 1990, now U.S. Pat. No. 5,137,179, issued Aug. 11, 1992.

BACKGROUND OF THE INVENTION

The present invention relates to containers as well as to a method for readying a container for filling and to a method for manufacturing a container.

More particularly the present invention is especially directed to a twin-chamber container of the kind comprising an outer container with a valve mounted thereon, an inner collapsible container mounted in communication with the valve, whereby the outer and the inner containers define an intermediate chamber; in some aspects the invention is also directed to single chamber containers for a pressurized product.

Further, the invention relates to a method for preparing a twin-chamber container ready to be filled with a product and to a method for manufacturing a plastic container and further to a plastic container.

DESCRIPTION OF PRIOR ART

Twin-chamber containers are known and widely used, so as for cosmetic products. They comprise an outer container made of a metal, steel or aluminium, whereon there is mounted a valve. The valve communicates with an inner collapsible container, wherein a product is stored.

In such twin-chamber containers, an intermediate chamber formed between the outer container and the inner collapsible container is pressurized with a gas so that when the valve communicating with the inner container is opened, the gas pressure within the intermediate chamber ejects the product contained in the inner collapsible container.

Thereby the outer container is made of two or three pieces, i.e. a bottom piece, a cylindric main body and a neck portion, whereby either the neck portion or the bottom part may be integrally formed with the main cylindric part. The joint of the two or three parts is realized by welding and mostly the main cylindric part of the outer container comprises a welding seam alongside. Considering the efforts to manufacture such outer containers and the expensive metal material used therefor and in view of the fact that mostly such twin-chamber containers are thrown away once they have been emptied, it becomes obvious that such metallic outer containers have considerable drawbacks.

It is further known to manufacture twin-chamber containers of the kind mentioned above, the intermediate chamber of which being pressurized with a gas, so that they leave the manufacturing plant in empty, unpressurized state. It becomes thus necessary that such twin-chamber containers be pressurized at the filling station where the inner collapsible container is filled with the specific product.

Up to now, pressurizing and product filling operations for such twin-chamber containers were thus performed at the same location. This is a serious disadvantage in that normally the container filler or manufacturer of the product to be filled in is not familiar with the pressurizing technique or would not like to be bothered therewith. Analogically the container manufacturer is not familiar with product handling, but would be with pressurizing technique of the container produced at his plant.

For aseptic products, as for saline solution for cleaning contact lenses, it was common practice to sterilize the filled containers. As sterilizing expenses, e.g. by γ-radiation, are substantially proportional to the volume to be sterilized and, from the overall filled container, only those parts would necessitate to be sterilized which are or come in contact with a product to be kept aseptic, one may recognize that this known sterilizing technique is far too expensive.

It is further known that containers comprising a plastic container body are especially then critical in use when they are subjected to mechanical stress or to a considerable internal pressure relative to pressure of the outside surrounding.

Thus, accidents may be caused if from such pressurized containers valves are ejected due to an unsafe seat of such valves on respective container bodies, which seat normally involves a metal to plastic material joint. Even for one chamber containers which contain a pressurized product as for aeorosol containers, the linkage of a valve arrangement to the plastic material or to the metal container body is a critical problem in view of tightness which is to be installed and maintained at such a linkage area.

In producing plastic container bodies in a desired shape, so as especially by blowing such containers from plastic preforms, it is further known that predetermined areas of such container bodies become weaker and less stress resistant than others. This leads to the necessity of making the thickness of the plastic wall larger along the overall container body to make sure that the required thickness is realized along all parts of the container body. This clearly necessitates the use of too much plastic material, resulting in plastic container bodies which are along the predominant part of their walls over-dimensioned.

A further problem encountered for plastic container bodies is that often distinct cover means, as metallic covers, glass covers etc., should be sealingly mounted to these container bodies. This causes mostly considerable problems in that two materials have sealingly to be linked which may, in fact, not be intimately joined as by welding.

SUMMARY OF THE PRESENT INVENTION

It is a first object of the present invention to resolve the drawbacks encountered with twin-chamber containers with metallic outer containers.

According to the present invention, this is achieved by providing for such a container an outer container which is at least substantially made of plastic material.

It is a further object of the present invention to get rid with local combining of pressurizing operation for twin-chamber containers and filling operation, this for such containers with an outer container of metal or of plastic material.

According to the present invention, this is achieved by pressurizing the intermediate chamber of such containers there, where the container is manufactured, and transporting such twin-chamber containers in pressurized state to the filling station. There the product manufacturer and filler needs not anymore bother with any pressurizing problems.

If thereby the container is prepared to be filled with an aseptic product as with a pharmaceutical product, the sterilization operation is considerably improved by sterilizing a sub-assembly of the inner, flexible container and of the valve mounted thereon and then mounting said sub-assembly into the outer container. The product is aseptically filled through the valve which has been previously sterilized and kept sterile up to the filling operation.

It is a third object of the present invention to remedy the weakness and/or sealing problems at plastic container bodies, this preventing accidents which may occur due to these problems if they are not accurately resolved. This is achieved by introducing into such a plastic container body a flowable material having it to flow within the container body to a predetermined area and hardening the material there, be it and preferably by a self-hardening process or by an additional hardening treatment, such as by applying heat at least to the still flowable material within the container body, as by radiation, e.g. microwave-radiation. By this technique sealing problems at one chamber containers for a pressurized product and at the link of container body and valve arrangement may also inventively be solved.

Other features and advantages of the present invention will become apparent upon perusal of the following specification, taken in connection with the accompanying drawings, illustrating examples of the present invention, wherein:

DESCRIPTION OF THE PREFERRED EMBODIMENTS

Figure 1:
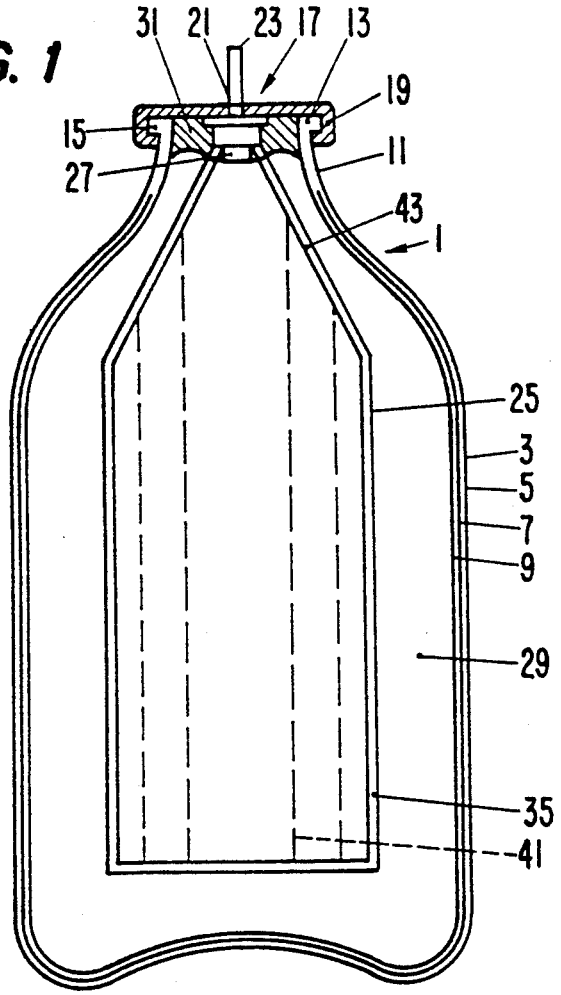
FIG. 1 in cross-section schematically the construction of a preferred twin-chamber container according to the present invention, FIG. 2 schematically a preferred embodiment of an inner container used for the inventive container according to FIG. 1, FIG. 3 the inner container of FIG. 2 in rectangular shape and before being folded, FIG. 4 schematically the shape of an outer plastic container which may be used for the container of FIG. 1, FIG. 5A schematically shows the introduction of a flowable material according to the present invention into a plastic container, FIG. 5B schematically shows the placement of the inner container and valve on the plastic container after the flowable material has been introduced into the plastic container.

In FIG. 1 there is schematically shown, in cross-section, a twin-chamber container 1. An outer container 3 thereof is made of three layers of bi-axially blow-stretched plastic material known as PET material. Thus, the outer container comprises three layers 5, 7 and 9 along substantial parts of its wall. Well-known three or multi layer bi-axial blow-stretching operations of a plastic material casting, resulting in a container body with a neck portion 11 of the outer container 1, have the drawback that the three layer structure is not anymore encountered at the upper end of the neck portion 11, but terminates below the open end 13 of the said neck portion 11.

On top of the neck portion 11, comprising a rim 15, there is applied a valve arrangement 17 with a metallic intermediate cover 19 and with a central valve 21 thereon. The valve 21 is of the type which is opened by mechanical tilting or pressing on a valve stud 23. The intermediate cover 19 is curled around the rim 15 so that the cover 19 and thus the valve arrangement 17 are mechanically fixed to the open end of the neck portion 11.

The valve 21 communicates with the inside of an inner container 25 which is collapsible.

This container 25 is mounted at an area 27 to the valve 21.

As may be recognized, this container 1 has on one hand in its neck portion 11 an area of reduced wall strength because of the lack of three layer structure, which three layer structure considerably improves the strength of the container wall.

As an intermediate chamber 29 between the outer container 1 and the inner container 25 is pressurized by a gas in this embodiment of the inventive container, on the other hand, the valve arrangement 17 with its cover 19 must be sealingly fitted on the open end of neck portion 11.

Further, the inner container 25 must sealingly be mounted at the area 27 to the valve 21 to prevent a product contained within the inner container 25 to penetrate into the intermediate chamber 29 and/or to prevent the pressurized gas within the intermediate chamber 29 to penetrate into the inner container 25 with the product, and then to leave the inner container through the valve 21.

To resolve all the said three problems of sealing as well as of outer container wall weakness at the neck portion 11, there is provided a layer 31 of a material which may be applied in substantially flowable state and which, afterwards, is hardened, preferably by self-hardening at normal atmosphere or at the gas atmosphere of pressurized gas.

Such a material is preferably an epoxy resin which is introduced into the outer container 1. The resin is preferably mixed from two components before introducing into the outer container 1 and is then made to flow onto the neck portion of the container, after that the inner container 25 and, mounted thereon, the valve arrangement 17 has been mechanically fixed to the outer container 1.

Instead of an epoxy resin as preferred, other resins may be used, either one component or more than one component resins.

Such resins used, first in flowable condition, do, once applied, either self-harden or are hardened by a reaction with a gas pressurizing the intermediate chamber 29, or are hardened by a hardening operation, as by a radiation, such as microwave radiation through the wall of the outer container 1.

As may be seen in FIG. 1, where the material of layer 31 is shown in hardened state, the layer 31 ensures optimal sealing of the valve arrangement 17 with respect to the outer container 1 as well as of the valve 21 to the inner container 25, and additionally reinforces the upper portion of the weakened neck portion 11 of the container 1.

Figure 2:
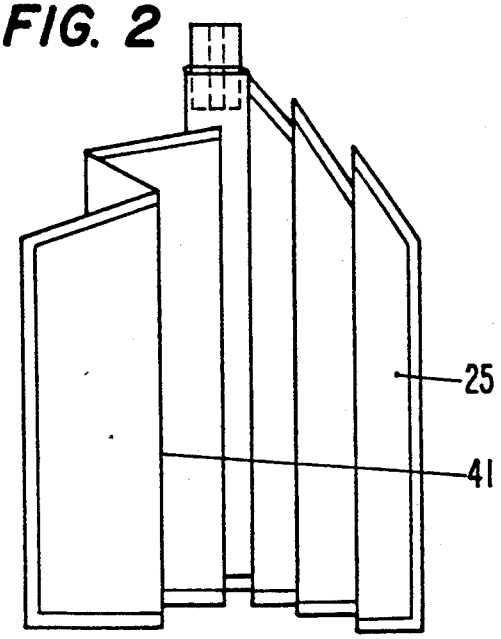

In FIG. 2 there is schematically shown the construction of the inner container 25 as is preferably used with the inventive container of FIG. 1. Such an inner container is further disclosed in the European application no. 0 105 537, published Apr. 18, 1984, which is incorporated in the present description by reference.

Figure 3:
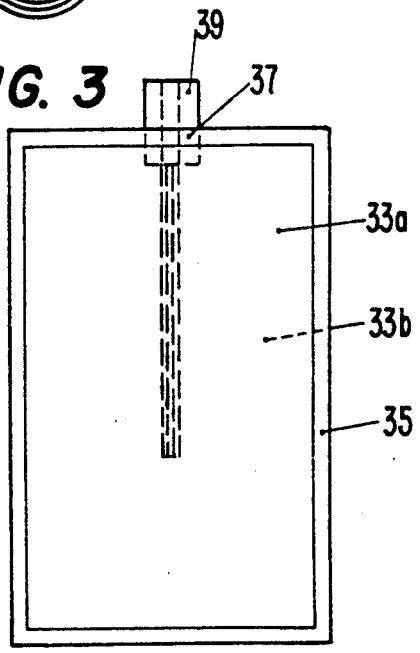

The inner container 25 consists, as shown in FIG. 3, of two foil-like wall members 33*a* and 33*b*, e.g. of rectangular shape, which foil-like members are joined at their periphery 35 to finally form a flat bag. There is fixed at a mounting area 37, which may accord to the mounting area 27 of FIG. 1, a stud 39 or directly an output tube of the valve 21 according to FIG. 1 which penetrates into the bag formed by the two foil-like members 33*a* and 33*b*.

As shown in FIG. 2, the flat bag is folded along substantially parallel folds 41 to be easily introduced into the outer container 1 of FIG. 1 and to expand as it is filled by a product.

Preferably, the two foil-like members 33*a* and 33*b* are made of a metallic foil which is plastic coated on one or on both sides, such as a laminated aluminium foil. The foil members 33*a*, 33*b* are sealingly joined as by welding at the periphery 35.

Different from the known internal container bag, as shown in FIG. 3 and as known from the above mentioned reference, the inner container 25 and thus the bag, as a preferred embodiment thereof, tapers towards its mounting area to the valve.

Tapering 43 of the container 25 as shown in FIG. 1 is provided to prevent lateral parts of the inner container 25, which is collapsible, from being rigidly fixed by the hardened material of layer 31.

The outer container 1 might also be made of a one layer bi-axially blow-stretched plastic material or of blown plastic material in general, here again one or multi layered. The fact that the outer container 1 is made of a plastic material generally leads, additionally to the advantages which were mentioned above, to the further advantage that other forms than cylindric may be easily realized.

Figure 4:
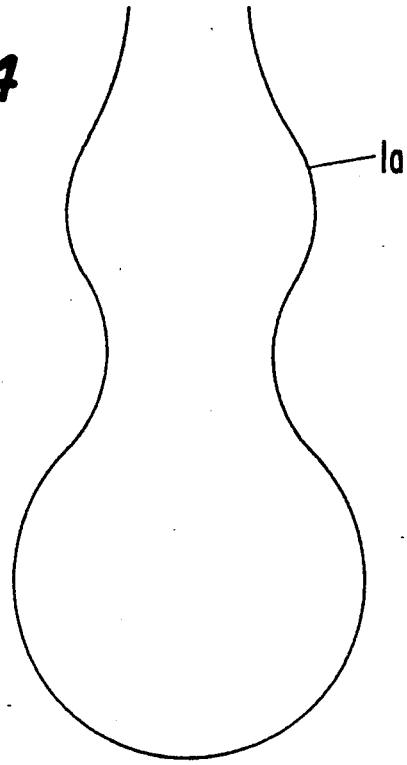

FIG. 4 schematically shows such another shape of a container 1*a* used as an outer container 1 as shown in FIG. 1. Thus, the fact of making the outer container of plastic material leads to considerable advantages with respect to metallic outer containers.

In other embodiments of the inventive twin-chamber container, a preferred embodiment of which being shown in FIG. 1, the layer of material, according to the layer 31 of FIG. 1, may only cover and seal the joining area of the valve arrangement 17 and of the outer container 1 and not additionally the mounting area 27 of the inner container 25 to the valve 21. Further, the inventive container could have an inner container, according to the container 25 of FIG. 1, which is not mounted to the valve, but which is mounted to the inside of the neck portion 11 of the outer container 1 or which is even just embedded with its open end into material as used to form the layer 31 of the FIG. 1 embodiment.

Pressurizing of the intermediate chamber 29 of the container according to FIG. 1 or generally of an inventive container with a plastic material outer container is performed either in that after or simultaneously with introducing the yet flowable material which later forms the layer 31 into the outer container 1, at least the open neck portion of the outer container 1 is applied to a pressurized atmosphere of the respective pressurizing gas and the valve arrangement with the inner container 25 are introduced into the outer container 1 during this pressurizing.

A considerable simplification of the pre-pressurizing operation—final pressure will only be installed within the intermediate chamber 29 once the inner container 25 is filled—is to introduce a pressurizing gas, preferably $H_2$ in its frozen, e.g. liquid form at low temperature into the outer container, mounting thereon the inner container 25 and the valve arrangement 17 still at low temperature and then applying the assembled container to normal temperature so that the frozen gas will evaporate and pressurize the intermediate chamber. Other gases as $CO_2$ gas could be analogically used in frozen, i.e. liquid or rigid state.

We use the expression "frozen gas" for a gas brought to liquid or rigid state.

The technique of pressurizing by introduction of frozen gas into the container 1 considerably speeds up the well-known "under cup"-pre-pressurizing technique at which pressurizing is performed through the opening of the outer container on which thereafter the valve arrangement is mounted.

Another possibility for pressurizing the intermediate chamber 29 is to provide within the wall of the outer container 1 an opening for later pressurizing and then having material which latter forms the layer 31 flowing on and into said opening and having said material on said opening hardened. Such pressurizing opening could be arranged at the neck portion 11 of FIG. 1 and sealing respective openings would be done by having the still flowable material flowing in and on such openings before hardening. Such material as the resins mentioned above would seal small pressurizing openings already in still flowable state.

Pressurizing of the twin-chamber container occurs at a container assembling plant. Then the assembled, pressurized container is conveyed or transported to a filling station, which may be distant, and is filled there with the respective product through the valve, as through the valve 21 of FIG. 1.

If the assembled and pre-pressurized container is used for an aseptic product as for a pharmaceutical product, then inventively a sub-assembly of the valve 21 mounted on the inner container 25 is sterilized preferably by subjecting this sub-assembly to $\gamma$-radiation. Then this sterilized sub-assembly is introduced into and on the outer container 1. As only the inside area of the sub-assembly 25, 21 must be kept aseptic, no problem occurs after sterilization due to handling or manipulation of the sub-assembly.

Preferably the open end of the valve stud 23 is hermetically sealed as welded before sterilizing the sub-assembly and maintained sealed up to aseptic filling of the inner container mounted within the outer container through the valve, whose sealing then being opened.

Before or during mounting the sterilized sub-assembly, again a gas, preferably a frozen gas is introduced into the intermediate chamber 29 as well as the flowable resin material.

Figure 5A:
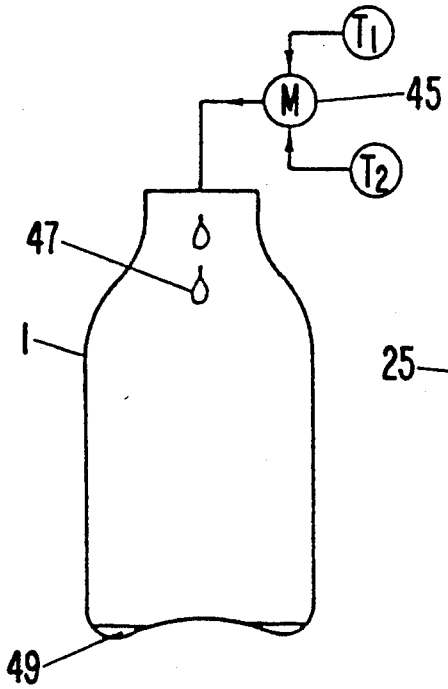
FIG. 5C shows the manipulation of the container to have the flowable material flow on a pedetermined part inside the container where it hardens, FIG. 6 schematically a plastic container as manufactured by blowing a plastic material preform, showing varying wall thickness, FIG. 7 schematically the manipulation of a container body as shown in FIG. 6 with filled-in flowable material for dispensing this material on wall portions with lower thickness for their reinforcement, FIG. 8 schematically a part of an open plastic container with a cover and application of a flowable, then hardening material inside the container to seal the cover.
Figure 5B:
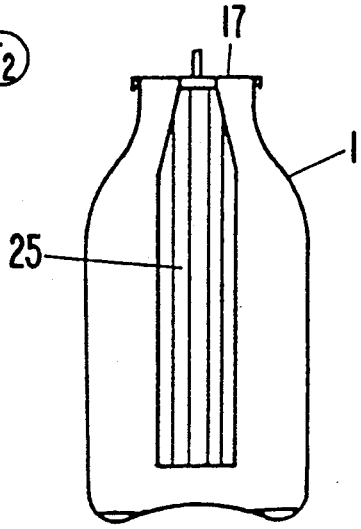
Figure 5C:
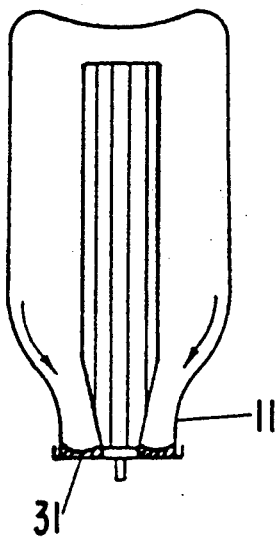

FIG. 5 schematically shows how the container is manipulated to finally flow the material still in flowable state onto the neck portion to finally form the hardened layer 31. E.g., two components of resin are mixed, as schematically shown, in a mixer 45 and introduced into the outer plastic container 1 in substantially flowable state as shown at 47. It first flows on the bottom of the container 1 as shown at 49. After application of the valve arrangement 17 with the inner container 25 and at least mechanically fixating the valve arrangement to the outer container 1, the twin-chamber container is turned upside down, so that the still flowable material flows from the bottom, as shown at 49, on the required area in the neck portion 11. The container is left in this upside down position up to substantial hardening of the material to form layer 31.

It must be emphasized that the inventive application of a layer 31 and especially of a resin as of an epoxy resin at a predetermined area of a container made of a plastic material leads to the considerable advantage that, when hardening, a highly intimate bond between the plastic material of the container and the said resin material occurs. This prevents any penetration of a gas or any other material through such a bond.

This technique may also be used for improving the seal of a valve arrangement on a metallic or plastic material container body of a single chamber container for a pressurized product, as for conventional aerosol containers. As in such containers the pressure is considerably higher than in two chamber containers, one has been very cautious in using plastic material container bodies.

Even using metallic container bodies, the linkage area of valve arrangement and container body is a critical area with respect to tightness and mechanical strength.

Thus, by reinforcing the linkage area of the valve arrangement and the container body, be it of a metal or of a plastic material of a one chamber container for a pressurized product, the said leakage and stress resistance problems are resolved. This reinforcing is done as was just described for two chamber containers.

The concept which was described in connection with the preferred embodiment of an inventive twin-chamber container as shown in FIG. 1 and with respect to general sealing action and reinforcing action, may be inventively applied even under much wider aspects.

Figure 6:
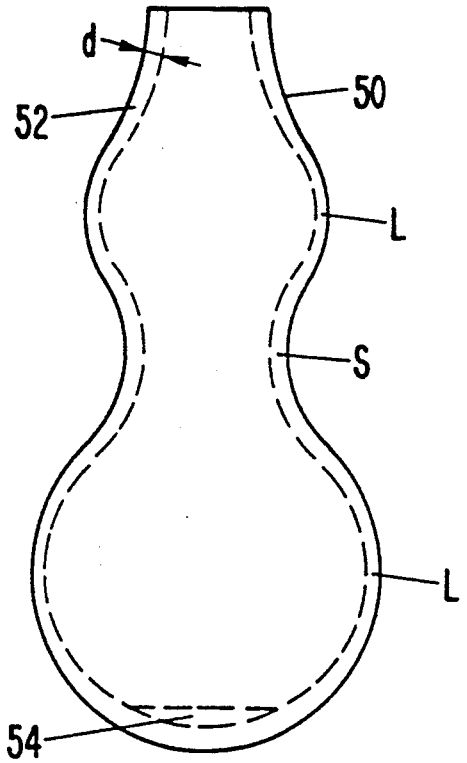

In FIG. 6 there is shown a plastic container body with a shape according to the body shown in FIG. 4. As shown in dash line, when producing such a body 50 as e.g. by blowing a plastic material preform or blow-stretching or bi-axially blow-stretching such a preform, in one, two or more than two layer technique, the thickness d of the resulting container body wall 52 may vary along the extent of the container body, resulting in areas L of lower wall thickness and strength and area S of higher thickness and strength.

If there is required a predetermined strength of the entire wall of the body 50, the areas L with the lowest wall thickness must have the thickness according to the stress requirements, according to the plastic material used. This would result in wall areas S becoming over-dimensioned. Following the inventive concept and as schematically shown in FIG. 6, there is introduced in such a container a predetermined amount 54 of a material in substantially flowable state, which material being the same material as was discussed in connection with layer 31 of FIG. 1, i.e. a material which hardens. Hardening may be a self-hardening or a hardening when subjected to a hardening operation as to heating or to a radiation treatment. Such a material may be a one or two component resin and is preferably an epoxy resin.

Figure 7:
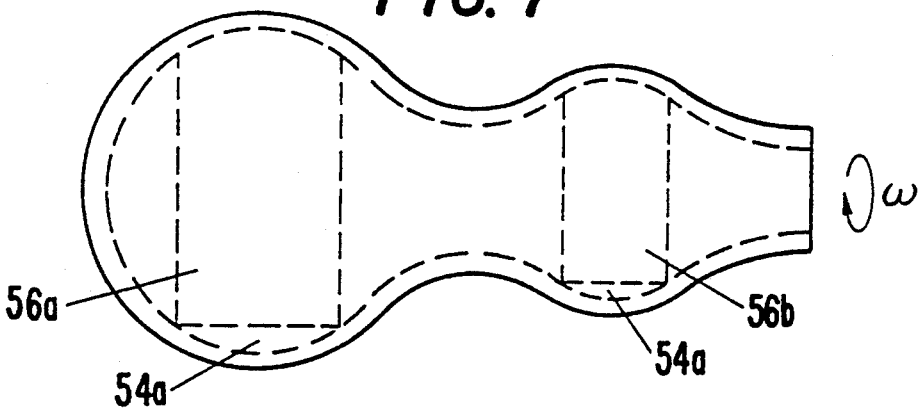

After application of the said material in substantially flowable state into the container body 50 according to FIG. 6, the container body is manipulated as shown e.g. in FIG. 7. It is first tilted to divide the material at 54 on the two reduced thickness areas L and then rotated slowly as shown in FIG. 7 by $\omega$.

Thus, reinforcing layers 56*a* and 56*b* are formed in the respective container areas of reduced wall thickness. This avoids the necessity of over dimensioning substantial parts of the wall of the body 50.

Figure 8:
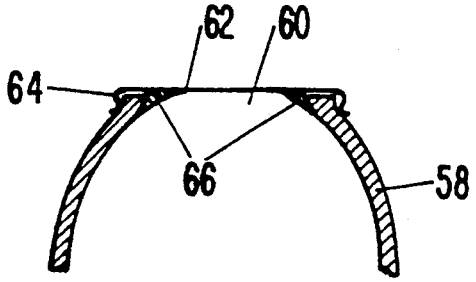

Whereas, in connection with FIG. 6 and 7, the general use of a layer according to the layer 31 of FIG. 1 has been shown for reinforcing purposes, in FIG. 8 such a use is schematically shown for sealingly joining a distinct cover part to the opening of a plastic or non plastic container body. In FIG. 8 there is schematically shown a part of a container 58 with an opening 60, covered by a schematically shown cover 62. The cover 62 is mechanically fixed to the container 58 around its opening 60, as shown at 64.

To ensure sealing of the cover 62 with respect to the inside of the container body 58, a layer 66 of the described type of material is brought inside the area to be sealed and is hardened there. This technique may be used for all plastic containers where high care must be taken to prevent any gas exchange between the surrounding and the interior of the container, such as for medical and pharmaceutical product containers and also for metallic containers for optimal sealing.

I claim:

1. A method for readying a twin-chamber container to be filled with a product, said container comprising an outer container, a valve, an inner collapsible container communicating with the valve and located within the outer container so as to define an intermediate chamber between said inner container and said outer container, said valve penetrating through said outer container, comprising the step of pressurizing the intermediate chamber between said outer container and said inner container with a gas and transporting the twin-chamber container with said pressurized intermediate chamber to a filling station for filling a product into said inner container through said valve.

2. The method of claim 1, comprising the step of introducing a frozen gas into said intermediate chamber to pressurize it.

3. The method of claim 2, comprising the step of introducing said frozen gas into said outer container, before or during locating of said inner container with said valve into said outer container.

4. The method of claim 1, comprising the step of preparing a sub-assembly of said inner collapsible container and said valve, sterilizing said sub-assembly so that at least the inside of said inner container and said valve communication with said inside of said inner container become aseptic and mounting said sterilized sub-assembly into said outer container.

5. The method of claim 4, wherein said step of pressurizing said intermediate chamber is performed before or after said mounting.

6. The method of claim 1, comprising the step of introducing a substantially flowable resin into said outer container, mounting said inner container into and said valve on said outer container, manipulating said container so as to flow said flowable resin within said intermediate chamber to a mounting area of at least said outer container, said valve and possibly said inner container and having said resin hardened at said mounting area.

7. The method of claim 6, comprising the step of introducing a frozen gas into said outer container before mounting said inner container into and said valve on said outer container, to pressurize said intermediate chamber due to evaporation of said frozen gas.

8. The method of claim 6, said flowable resin being a two-component resin.

9. The method of claim 6, said flowable resin being an epoxy resin.

* * * * *